United States Patent [19]

Lesyk

[11] 4,147,207

[45] Apr. 3, 1979

[54] CONVECTIVE-TYPE RADIATOR WITH INTERNAL HEAT TRANSFER MEDIUM

[75] Inventor: Leo Lesyk, Walton Hills, Ohio

[73] Assignee: Bird Electronic Corporation, Solon, Ohio

[21] Appl. No.: 825,645

[22] Filed: Aug. 18, 1977

[51] Int. Cl.[2] ..... F28D 15/00

[52] U.S. Cl. ..... 165/106; 165/128; 333/22 R

[58] Field of Search ..... 165/106, 128, DIG. 16; 333/22 R, 22 F; 219/365, 378

[56] References Cited

U.S. PATENT DOCUMENTS

| | | | |
|---|---|---|---|
| 2,958,830 | 11/1960 | Bird et al. | 333/22 R |
| 3,253,123 | 5/1966 | Welch | 219/365 |
| 3,610,327 | 10/1971 | Rutherford | 165/106 |

FOREIGN PATENT DOCUMENTS

| | | | |
|---|---|---|---|
| 695166 | 8/1953 | United Kingdom | 333/22 F |

*Primary Examiner*—Albert W. Davis, Jr.

*Attorney, Agent, or Firm*—Bosworth, Sessions & McCoy

[57] ABSTRACT

A radiator for dissipating heat transferred from a liquid cooling medium contained therein and that circulates by convection around and absorbs heat energy from an internal heat source. The radiator has a housing that contains the liquid cooling medium and that has two upright end walls and four finned rectangular side walls that define a prism of advantageous aerodynamic form supported with its axis horizontal. The four side walls of the prism intersect in a horizontal plane and a vertical plane, both of which form diagonal planes of the prism. The finned side walls are adapted to transfer heat energy to the surrounding atmosphere and to establish convective flow in paths with minimum flow resistance, that extend upwardly from the intersection of the two lower side walls (i.e., at the nose of the aerodynamic form) at the bottom of the housing and across the entire surface area of the finned side walls to absorb heat energy transmitted to the finned walls by the liquid medium.

4 Claims, 3 Drawing Figures

CONVECTIVE-TYPE RADIATOR WITH INTERNAL HEAT TRANSFER MEDIUM

BACKGROUND OF THE INVENTION

This invention relates to radiators for cooling a fluid medium and especially to radiators for cooling a liquid medium, such as a dielectric oil that absorbs heat from an internal heat generator. More particularly, the invention relates to a novel construction for the finned, convective-type radiator housing for the dielectric oil that circulates by convection through and around a coaxial line termination associated with RF electrical equipment.

In RF electrical equipment utilizing coaxial transmission lines, it is often desirable to use certain types of line terminations or dummy loads for absorption of RF energy. One type of termination called the wet type utilizes a liquid cooling medium to carry off the heat energy generated by the dissipation of electrical energy across a load. These line terminations include, for example, those shown and described in U.S. Pat. Nos. 2,884,603; 2,958,830; 2,973,479, 3,054,074; 3,158,823 and 3,296,560.

The line termination or dummy load is customarily designed for use with a coaxial line of specific impedance and preferably is arranged to have an input impedance, which, over a large range of frequencies, is equal to the characteristic impedance of the line. Such a load may comprise an attenuating line section including an outer sleeve conductor tapered inwardly to its rearward end and an inner conductor axially mounted within the sleeve and joined thereto at its rearward end. The inner conductor is resistive in character and may be in the form of a thin resistive coating on a ceramic core. The line termination or dummy load is enclosed in a suitable housing filled with a liquid dielectric and the tapered outer conductor is perforated or slotted to allow the liquid dielectric, serving also as a coolant, to be in continuous contact, or heat-exchanging relation, with the inner conductor. The housing containing the bath of liquid dielectric may be cooled by radiant or convective loss of heat to the atmosphere.

The dielectric liquid within the housing is preferably one having a low dielectric constant, dielectric constants of the order of about three and below being satisfactory.

The liquid cooling medium is most advantageously contained in a radiator in which the dummy load is positioned. The radiator normally has a plurality of fins formed of conductive metal, such as aluminum, and which are heated by convection from the cooling medium and radiate the heat into the surrounding atmosphere. Thus, the heat energy from the line termination is dissipated by convection to the fins and finally dissipated by radiation from the fins to the surrounding atmosphere.

In prior art radiators of this type in which the line termination is positioned with its axis horizontal or parallel to the surface on which the unit is supported, the housing has normally been of rectangular form with fins extending outwardly from the side walls and, in some instances, from the top wall. With this construction, the convective flow of the surrounding atmosphere is in paths extending upwardly from the floor across the side walls and over a portion of the top. Essentially, no flow is developed across the bottom surface of the housing. Accordingly, efficient heat transfer from the walls of the housing occurs only around a portion of the outer surface of the housing. This relatively poor heat dissipation from the available heated housing surface results in a requirement for more liquid dielectric than might otherwise be required. Also, the boxlike shape of prior art radiators of this type produce a relatively high resistance to the upward flow of the surrounding atmosphere.

In some instances, to achieve faster cooling, fans are used with the radiators to blow the atmosphere upwardly against the bottom of the housing. While this method is effective, it does not achieve optimum flow paths for the surrounding atmosphere due to the difficulty in directing the atmosphere around a rectangularly shaped body.

The radiator construction of the present invention, however, reduces the difficulties indicated above and affords other features and advantages heretofore not obtainable.

SUMMARY OF THE INVENTION

It is among the objects of the invention to provide an improved radiator for dissipating heat to surrounding atmosphere from a liquid cooling medium contained in the radiator and with reduced resistance to the flow of the surrounding atmosphere.

Still another object of the invention is to provide a radiator of the type described with improved facility to generate an aerodynamic flow of atmosphere around the heated surfaces of the radiator to achieve more efficient heat transfer.

Still another object of the invention is to improve the efficiency of heat transfer from a radiator containing a volume of a liquid dielectric cooling medium by optimizing the exposure of the heated walls of the housing containing the heated cooling medium to surrounding atmosphere in which paths of flow are generated during the cooling process.

These and other objects and advantages are achieved by the novel convective-type radiator construction of the invention which is adapted to radiate heat energy transferred to it by a cooling medium therein. The unit comprises a housing containing the liquid medium and having upright end walls and at least four finned rectangular side walls defining a prism of advantageous aerodynamic form, supported with its axis horizontal and having the four sides intersecting in a horizontal and in a vertical plane, the planes forming diagonal planes through the prism. The finned side walls are adapted to transfer heat energy to the surrounding atmosphere and to establish convective flow of the atmosphere in paths that extend upwardly from the V-shaped intersection of the two lower side walls and across the entire finned surface of the four side walls to absorb heat energy transmitted to the finned side walls by the liquid medium.

The prism-shaped housing, as viewed in transverse cross section, is generally diamond-shaped, although the sides of the diamond-shaped cross sectional form may not all be equal, in order to provide an efficient aerodynamic form. For example, the upper two side walls are more advantageously longer than the two lower sides of the diamond form.

In some circumstances, the radiator is used in connection with blowers mounted below the unit and adapted to direct the flow of atmosphere upwardly. The forced flow assumes aerodynamic flow paths with minimum flow resistance upwardly around the finned walls of the radiator.

DESCRIPTION OF THE PREFERRED EMBODIMENT

Referring more particularly to the drawings, there is shown a convective-type radiator of the type used to dissipate heat energy from a liquid cooling medium, such as a dielectric oil contained therein. The dielectric cooling medium is heated, for example, by a coaxial line termination, such as the type used in the unit manufactured and sold by Bird Electronic Corporation of Solon, Ohio, under the trade designation Model 8785. The line termination converts RF electrical energy to heat energy and the heat energy is transferred by conduction to the liquid dielectric cooling medium contained in the radiator.

The radiator comprises a finned body 10 that serves as a reservoir, or tank, for a liquid dielectric 11 in which a line termination 12 of the tapered horn type (see above) is immersed. The liquid dielectric 11 may be any suitable liquid, such as that available commercially under the trade designations "DOWTHERM A" or "DC 200". The housing 10 may be made of sheet material, such as steel, copper, brass, aluminum, or the like, material of good heat conductivity being most desirable.

Figure 1:
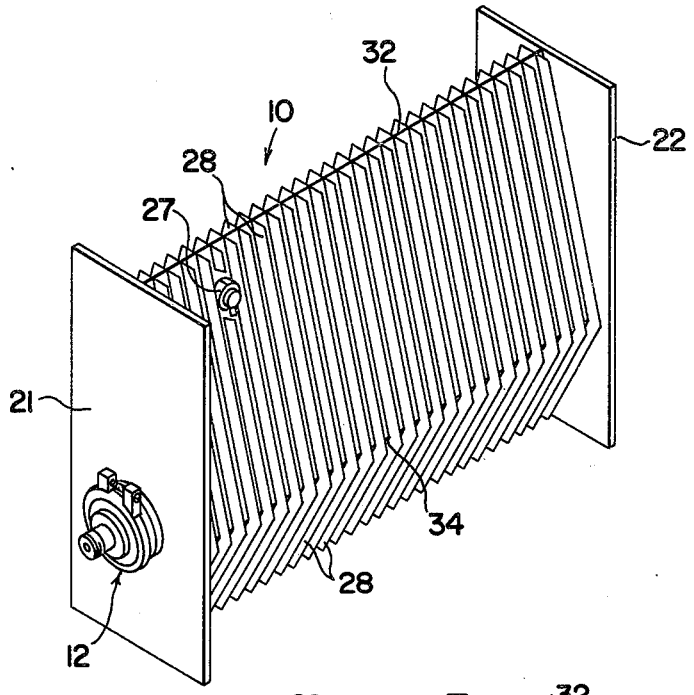
FIG. 1 is a perspective view of a convective-type radiator with an internal heat transfer medium embodying the invention and designed for use in association with an RF line termination.
Figure 2:
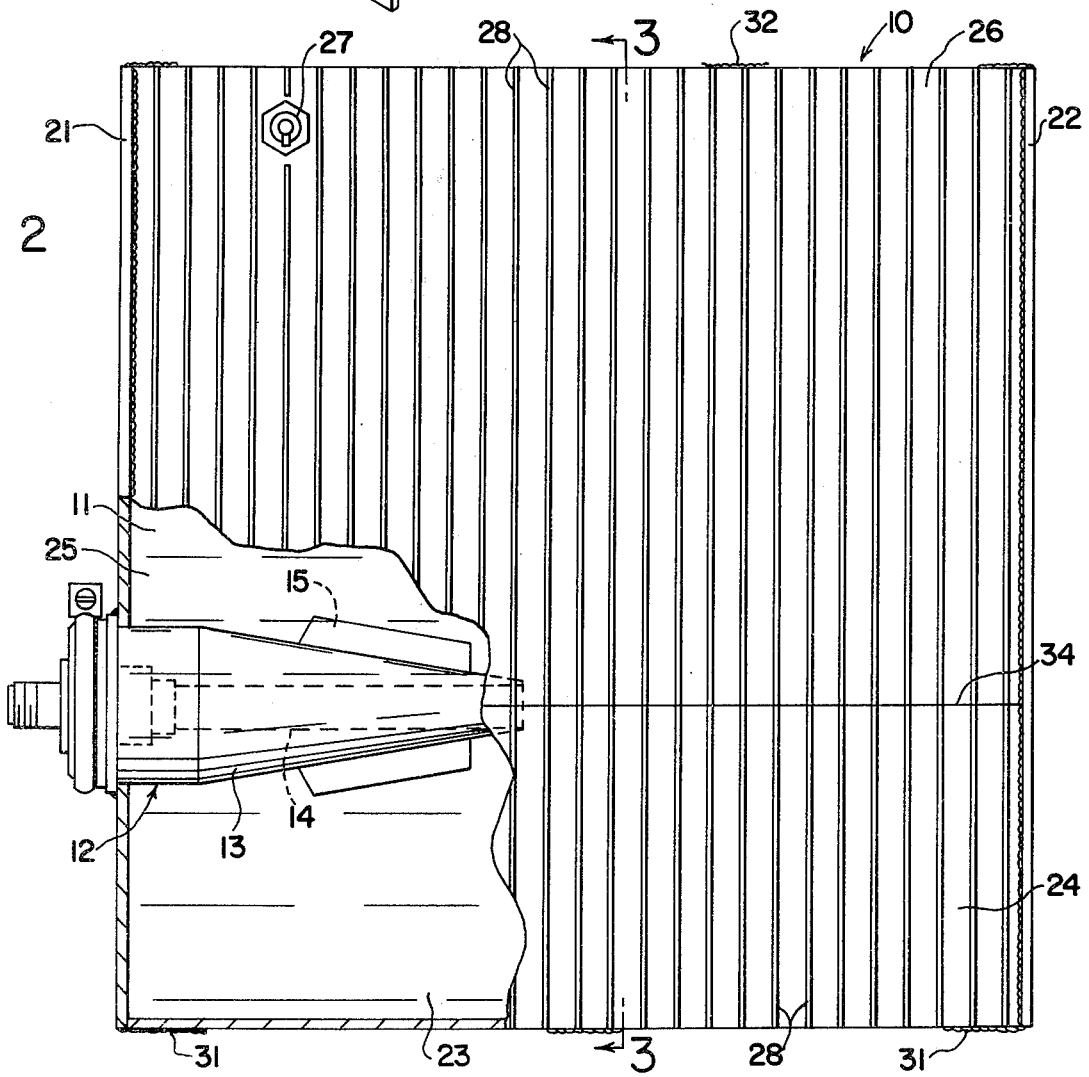
FIG. 2 is a side elevation of the radiator of FIG. 1 with parts broken away for the purpose of illustration.

The line termination 12 is positioned in a horizontal position in the radiator, as shown in FIG. 2, and comprises a hollow horn, or shell, 13 which is of tubular form tapering inwardly to its rearward end. The horn 13 surrounds the inner or resistive conductor 14 in coaxial relation and is preferably tapered exponentially. The inner conductor 14 may comprise a ceramic tube coated with a layer of resistive coating sufficiently thin to eliminate skin effect in relation to currents flowing thereto throughout the range of frequencies for which the device is designed. The coating may be in the form of carbon, tungsten, platinum, or other metal applied by vacuum vaporization, sputtering, painting in colloid dispersion, electrolytic deposition, or other known methods. The outer tapered conductor 13 is perforated to allow the circulation of the liquid dielectric therethrough. These perforations may be in the form of longitudinal slots 15, as shown in FIG. 2.

The radiator comprises a pair of upright end plates 21 and 22 of rectangular form and adapted to provide supports for setting the radiator on a horizontal surface, such as a floor, portable base, or the like. Located between the end plates 21 and 22 are four finned side walls fused to one another and to the end plates 21 and 22, such as by brazing or welding, to define a sealed enclosure for the liquid dielectric cooling medium 11. The side walls include a pair of lower side walls 23 and 24 and a pair of upper side walls 25 and 26, the four walls defining a horizontal-axis prism, more particularly, a right quadrangular prism.

The finned walls of the prism, 23, 24, 25 and 26, define, as viewed in transverse cross section (FIG. 3), a quadrilateral plane figure of advantageous aerodynamic form with its longest diagonal being vertical, and its shorter diagonal being horizontal. Accordingly, the quadrilateral plane figure is symmetrical about its vertical and horizontal diagonals. The vertical diagonal is the flow axis when considered in terms of aerodynamic form.

Figure 3:
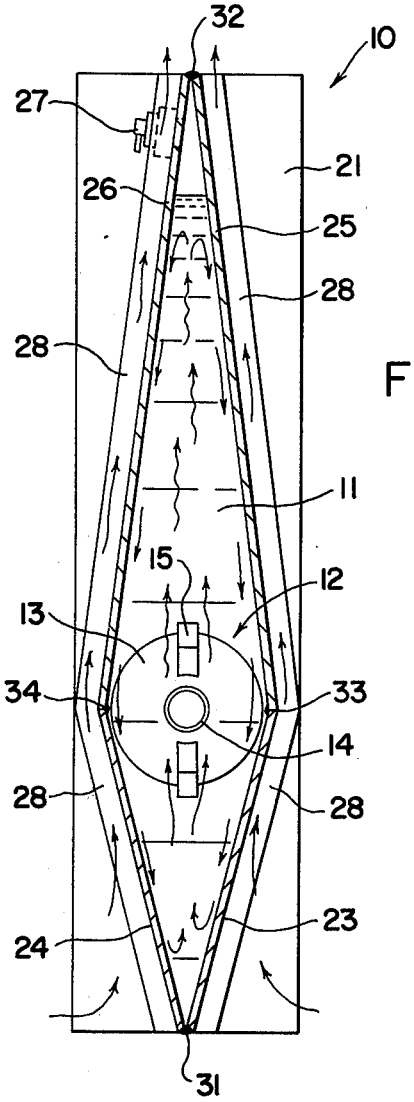
FIG. 3 is a sectional view taken on the line 3—3 of FIG. 2.

The resulting prism-shaped housing, generally speaking, has an efficient, low flow resistance aerodynamic form, as will be apparent from FIG. 3, so that a flow of minimum pressure drop may be established in an upward direction as viewed in FIG. 3. In other words, the resulting shape is capable of achieving relatively high efficiency of air flow in an upward direction.

To achieve the desired shape, it is preferred that the two lower walls 23 and 24 be of shorter length than the two upper walls 25 and 26 so that the maximum thickness of the shape, as viewed with respect to its aerodynamic form, occurs at a point at approximately one-third of the distance upwardly along its longest diagonal, or flow axis.

The walls 23, 24, 25 and 26 are fused to one another at their intersections, including a V-shaped, acute angle bottom intersection at 31, an acute angle top intersection at 32, and two obtuse angle side intersections at 33 and 34. A vent plug 27 is located in the upper side wall 26. As a precaution against overloading, there is normally provided a thermocouple unit immersed in the liquid dielectric coolant 11 and connected to a conventional electrical safety cut-out switch (not shown).

In the operation of the device, high-frequency electrical energy from a signal generator, such a television transmitter or other source, is absorbed and converted into heat energy by the line termination 12. The heat energy is transmitted by conduction to the liquid dielectric cooling medium 11 which circulates in the housing 10 and around the resistive coating on the inner conductive element 14. This heat transfer causes convective action of the liquid dielectric cooling medium 11 in the manner generally indicated by the arrows in FIG. 3. The heated liquid rises to the top of the housing and is replaced by cooler liquid which flows around the inner conductive element 14.

The heated liquid 11 transfers heat energy by conduction to the finned housing 10. The finned housing 10, in turn, transfers heat to the surrounding atmosphere by radiation and convection.

Due to the unique prism-shaped aerodynamic form of the housing 10, the finned surfaces 28 of all four side walls 23, 24, 25 and 26 are exposed to the surrounding atmosphere and, more importantly, to the convective flow of atmosphere across the finned surfaces. In the absence of a fan, the flow begins at the V-shaped intersection 31 of the lower side walls 23 and 24 and proceeds in an aerodynamic path upwardly across the lower side walls 23 and 24 and then across the upper side walls 25 and 26. The convective flow transfers heat energy from the housing 10 to the surrounding atmosphere and, thus, dissipates the heat initially generated by the line termination 12.

Because of the efficient heat transfer from the finned surfaces 23, 24, 25 and 26 of the housing 10, a relatively small volume of liquid dielectric coolant is required in order to achieve the necessary dissipation of heat energy. Also, the over-all external size of the radiator is smaller than prior art units due to the more efficient utilization of the available surfaces to achieve heat transfer from the finned walls to the surrounding atmosphere.

Another important advantage of the invention is that where fans are used to provide a higher volume of air flow across the finned walls of the radiator, an optimum aerodynamic shape is provided to minimize resistance to atmospheric flow and minimize the pressure drop in the stream of atmosphere flowing around the walls of the unit.

While the invention has been shown and described with respect to a specific embodiment thereof, this is intended for the purpose of illustration rather than limitation and other variations and modifications of the specific embodiment herein shown and described will be apparent to those skilled in the art, all within the intended spirit and scope of the invention.

I claim:

1. A radiator for cooling a liquid medium contained therein that circulates by convection around an internal heat source to absorb heat energy from said heat source, comprising:

a housing containing said liquid medium and having opposed end walls and at least four laterally finned quadrilateral side walls secured to said end walls, said side walls defining a prism of aerodynamic form with its axis horizontal, said side walls intersecting in perpendicular diagonal planes, including a horizontal plane and a vertical plane, through said prism said horizontal plane intersecting said vertical plane at a location more closely spaced to the lower end of said prism than to the upper end to provide an optimal aerodynamic prismatic form whereby said housing has a low resistance to the upward convective flow of atmosphere as said housing transfers heat energy to said upwardly flowing atmosphere and to provide a location for said internal heat source.

2. A radiator as defined in claim 1 wherein said finned side walls define a right quadrangular prism with its larger diagonal plane positioned vertically.

3. A radiator as defined in claim 2 wherein the diagonal plane of said right quadrangular prism that is perpendicular to said larger diagonal plane intersects said larger diagonal plane about one-third of the distance upward from the lower end of said prism.

4. A radiator as defined in claim 1 wherein said liquid medium is a dielectric oil.

* * * * *